US010969075B2

(12) United States Patent
Brandstetter et al.

(10) Patent No.: US 10,969,075 B2
(45) Date of Patent: Apr. 6, 2021

(54) ILLUMINATION DEVICE FOR A MOTOR VEHICLE HEADLIGHT

(71) Applicant: ZKW Group GmbH, Wieselburg (AT)

(72) Inventors: Martin Brandstetter, Ybbs (AT); Stefan Miedler, Unterradlberg (AT); Matthias Riesinger, St. Leonhard am Forst (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/766,889

(22) PCT Filed: Oct. 11, 2018

(86) PCT No.: PCT/EP2018/077704
§ 371 (c)(1),
(2) Date: May 26, 2020

(87) PCT Pub. No.: WO2019/101426
PCT Pub. Date: May 31, 2019

(65) Prior Publication Data

US 2020/0363030 A1 Nov. 19, 2020

(30) Foreign Application Priority Data

Nov. 27, 2017 (EP) ..... 17203860

(51) Int. Cl.
*F21S 41/135* (2018.01)
*F21S 41/64* (2018.01)
(Continued)

(52) U.S. Cl.
CPC ..... *F21S 41/135* (2018.01); *F21S 41/645* (2018.01); *F21V 9/14* (2013.01); *F21Y 2115/10* (2016.08)

(58) Field of Classification Search
CPC ..... F21S 41/135; F21S 41/645; F21V 9/14; F21Y 2115/10
See application file for complete search history.

(56) References Cited

U.S. PATENT DOCUMENTS 3,432,223 A * 3/1969 Uchida ..... G02F 1/03 359/247
4,069,458 A * 1/1978 Farcy ..... H01S 3/2316 359/337
(Continued)

FOREIGN PATENT DOCUMENTS

DE 102015115339 A1 * 3/2017 ..... F21S 41/135
DE 102015115339 A1 3/2017
(Continued)

OTHER PUBLICATIONS

Machine English Translation of WO2018046107A1 Mar. 2018 ; Fischer, Bernd.*
International Search Report for PCT/EP2018/077704, dated Apr. 1, 2019 (2 pages).
Search Report for European Patent Application No. 17203860, dated May 31, 2018 (2 pages).

*Primary Examiner* — Rajarshi Chakraborty
*Assistant Examiner* — Glenn D Zimmerman
(74) *Attorney, Agent, or Firm* — Eversheds Sutherland (US) LLP

(57) ABSTRACT

The invention relates to an illumination device (51, 52, 53) for a motor vehicle headlight, which illumination device comprises: an illumination means (100) wherein the light beams thereof can be collimated by at least one lens system (200); a polarising beam splitter (300), which divides the collimated light beams into a first and a second linearly polarised beam path (310, 320); a first means for polarisation rotation (400) which is configured to rotate the polarisation direction of the second beam path (320), such that the second beam path (320) has the polarisation direction of the first beam path (310); a reflective means (350) which is configured to deflect the first beam path (310); a single
(Continued)

Figure 1:
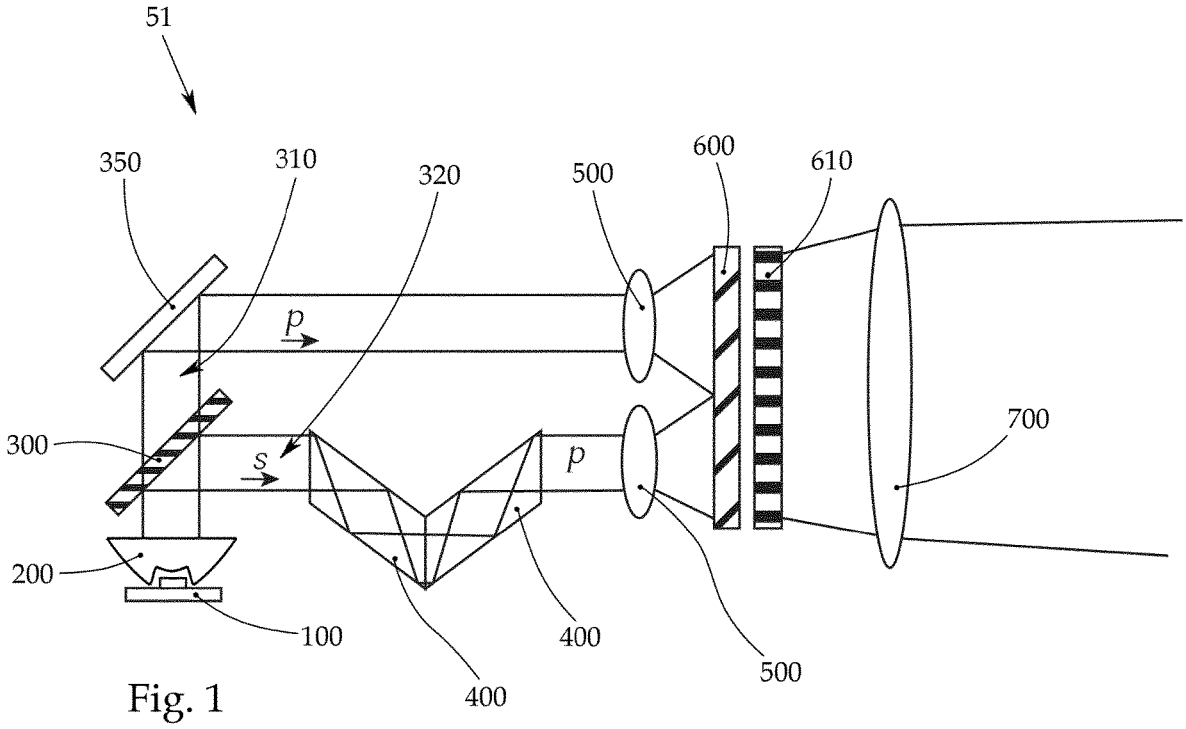

second means for polarisation rotation (600), having at least one segment which can be placed in an active and an inactive state by means of electrical signals; a polarisation filter means (610) which is configured to transmit or block the light beams that have been rotated in terms of their polarisation by the second means for polarisation rotation (600); and at least one projection lens (700) which is provided to generate a light distribution or a partial light distribution of a lighting function in front of a motor vehicle.

20 Claims, 3 Drawing Sheets

(51) Int. Cl.
*F21V 9/14* (2006.01)
*F21Y 115/10* (2016.01)

(56) References Cited

U.S. PATENT DOCUMENTS

| | | | | |
|---|---|---|---|---|
| 2009/0207379 | A1* | 8/2009 | Oakley | G03B 21/2013 353/20 |
| 2011/0216538 | A1* | 9/2011 | Logan | F21S 4/28 362/244 |
| 2016/0131920 | A1 | 5/2016 | Cook | |

FOREIGN PATENT DOCUMENTS

| | | | | |
|---|---|---|---|---|
| DE | 102015115348 | A1 | 3/2017 | |
| EP | 1351015 | A2 | 8/2003 | |
| EP | 1351015 | A2 * | 10/2003 | F21V 9/14 |
| EP | 3032168 | A1 | 6/2016 | |
| WO | WO-2018046107 | A1 * | 3/2018 | F21S 41/645 |

* cited by examiner

ILLUMINATION DEVICE FOR A MOTOR VEHICLE HEADLIGHT

The invention concerns an illumination device for a motor vehicle headlight.

The invention further concerns a motor vehicle headlight with at least one inventive illumination device.

Liquid crystal elements are also frequently used in headlight systems or in illumination devices for motor vehicle headlights, for example for a wide range of projection applications and/or ADB (adaptive driving beam) applications.

If a liquid crystal element is illuminated with unpolarised light from an illumination means, two polarisation filters are usually necessary, wherein one is arranged n the beam path upstream of the liquid crystal element, and one is arranged in the beam path downstream of the liquid crystal element.

The first polarisation filter serves to generate linearly polarised light, wherein, depending on the activation of the liquid crystal element, the linearly polarised light is either transmitted unaltered by the liquid crystal element, or its polarisation is rotated.

The polarisation filter arranged downstream of the liquid crystal element is usually arranged such that a light beam altered in terms of polarisation by the liquid crystal element is transmitted, whereas a light beam unaltered by the liquid crystal element is absorbed or reflected.

As a result of this practice, at least half the amount of light absorbed and/or reflected by the first polarisation filter is lost in this arrangement, as a result of which, in turn, the efficiency of the illumination device is reduced.

In addition, the first polarisation filter may heat up as a result of absorption at a high intensity of illumination, which can impair the function of the liquid crystal element.

It is an object of the invention to provide an improved illumination device, which increases the efficiency and effectiveness of an illumination device.

This object is achieved by the fact that the illumination device comprises the following:

An illumination means, which is configured to emit light beams, wherein the light beams can be collimated by at least one lens system installed downstream of the illumination means in the main direction of radiation, A polarising beam splitter installed downstream of the at least one lens system, which splits the light beams collimated by the lens system into a first and a second linearly polarised beam path, wherein the polarisation directions of the beam paths are rotated through 90° relative to one another, A first means for polarisation rotation, which is configured to rotate the polarisation of the second beam path through 90°, such that the second beam path has the polarisation of the first beam path, A reflective means, which redirects the first beam path essentially into the direction of the second beam path altered by the first means for polarisation rotation, A second means for polarisation rotation, installed downstream of the first means for polarisation rotation and the reflective means, which second means for polarisation rotation comprises at least one segment, which can be transposed between an active and an inactive state by means of electrical signals, wherein the polarisation of light beams can be rotated through 90° in the active state, and experiences no alteration in the inactive state, A polarisation filter means, which is installed downstream of the second means for polarisation rotation; which polarisation filter means is configured to transmit or to block the light beams rotated in terms of polarisation by the second means for polarisation rotation in the active or inactive state respectively, and At least one projection lens, which is provided to generate a light distribution, or a partial light distribution, of a light function ahead of a motor vehicle.

In an advantageous variant, such an illumination device can be used to generate the "dipped beam" light function, wherein for this "dipped beam" light function the illumination device generates a light distribution, which, when the illumination device is installed in a vehicle, generates a dipped beam distribution ahead of the vehicle in accordance with the legal requirements.

Provision can be made for such an illumination device to be used to generate the "main beam" light function, wherein for this "main beam" light function the illumination device generates a light distribution, which, when the illumination device is installed in a vehicle, generates a main beam distribution ahead of the vehicle in accordance with the legal requirements.

The light functions or light distributions listed above are not exhaustive; wherein the illumination devices may also produce combinations of these light functions and/or produce only a partial light distribution, that is to say, for example, only a part of a main beam, dipped beam, fog, or daytime running light distribution.

By means of the inventive illumination device, the entire, or essentially the entire, quantity of light that is emitted by an illumination means is used and brought onto the second means for projection rotation, that is to say, onto the projection lens.

Provision can be made for the illumination means to comprise at least one light source.

Provision can also be made for the illumination means to comprise two or a plurality of light sources.

Each light source can advantageously be assigned its own lens system, which directs the light emitted by the light source in a parallel manner.

It can be beneficial if the at least one light source is designed as an LED.

Provision is preferably made, in the case in which two or more light-emitting diodes are provided, that each light-emitting diode can be controlled independently of the other light-emitting diodes.

Each light-emitting diode can thus be switched on and off independently of the other light-emitting diodes of a light source, and preferably, in the case of dimmable light-emitting diodes, can also be dimmed independently of the other light-emitting diodes of the light source.

In a practical form of embodiment, the at least one lens system can be designed as a TIR lens.

Provision can advantageously be made for the first means for polarisation rotation to be designed as a Fresnel parallelepiped, wherein one end face of the parallelepiped is mirrored.

The first means for polarisation rotation can advantageously be designed as two Fresnel parallelepipeds, wherein the two parallelepipeds are preferably arranged directly behind one another.

The Fresnel parallelepiped with a mirrored end face, together with the two Fresnel parallelepipeds, which are arranged directly behind one another, serve to convert the polarisation direction of the second beam path into the same polarisation direction as the first beam path. By this means, the second means for polarisation rotation, preferably designed as a liquid crystal element, can be illuminated by the entire luminous flux or light quantity of the illumination means.

In general, a Fresnel parallelepiped is an optical prism that converts 45°-linearly polarised light into circularly polarised light after two total reflections at a certain angle.

In contrast to a delay plate, the advantage lies in the fact that the phase shift depends hardly at all on the wavelength of the light incident on the Fresnel parallelepiped.

For this purpose, 45°-linearly polarised light is directed at right angles, that is to say, orthogonally, onto one end face of the prism, wherein the light does not thereby experience any alteration of direction. The light then falls onto a first inclined longitudinal surface of the prism, wherein the angle of incidence of the light onto this longitudinal surface is greater than the critical angle of total reflection, and is totally reflected.

The resulting phase shift causes the originally linearly polarised light to become elliptically polarised light. For the generation of circularly polarised light, a second total reflection within the prism is necessary.

The angle of incidence depends on the refractive index of the material used, for example crown glass, whose refractive index is 1.51.

Provision can also be made for the at least one Fresnel parallelepiped to be formed from a plastic, for example polycarbonate or Tarflon.

In the case of two Fresnel parallelepipeds arranged directly behind one another, which have the same properties in terms of material and shape, a total of four total reflections occur, which, upon exit from the two prisms, convert the incident linearly polarised light into a 90°-rotated linearly polarised light.

Provision can be made for the second means for polarisation rotation to be designed as a liquid crystal element.

The function of a liquid crystal element, for example a liquid crystal display, which is made up of segments that can be individually activated, is based on the fact that liquid crystals, that is to say, the segments, influence the polarisation direction of light, if a certain level of electrical voltage is applied.

It should again be explicitly pointed out that a liquid crystal element as described here is composed of a plurality of liquid crystals, which are also referred to here as segments.

Provision can also be made for the reflective medium to be designed as a mirror.

In a further appropriate form of embodiment, provision can be made for the second means for polarisation rotation to be an LCoS element.

In contrast to LC displays, an LCoS (Liquid Crystal on Silicon) does not allow light through it; that is to say, it does not transmit the light, but rather reflects it.

It can be beneficial if the second means for polarisation rotation is preceded by at least one optical element, for example a lens or a reflector, which is arranged so as to permit homogeneous illumination of the second means for polarisation rotation by the beam paths incident on the second means for polarisation rotation.

However, the at least one optical element is configured in such a way that the polarisation of the light beams is not altered, or only altered to a very small extent.

Advantageously, two optical elements can be positioned in front of the second means for polarisation rotation, wherein the optical elements are each assigned to one beam path.

Figure 2:
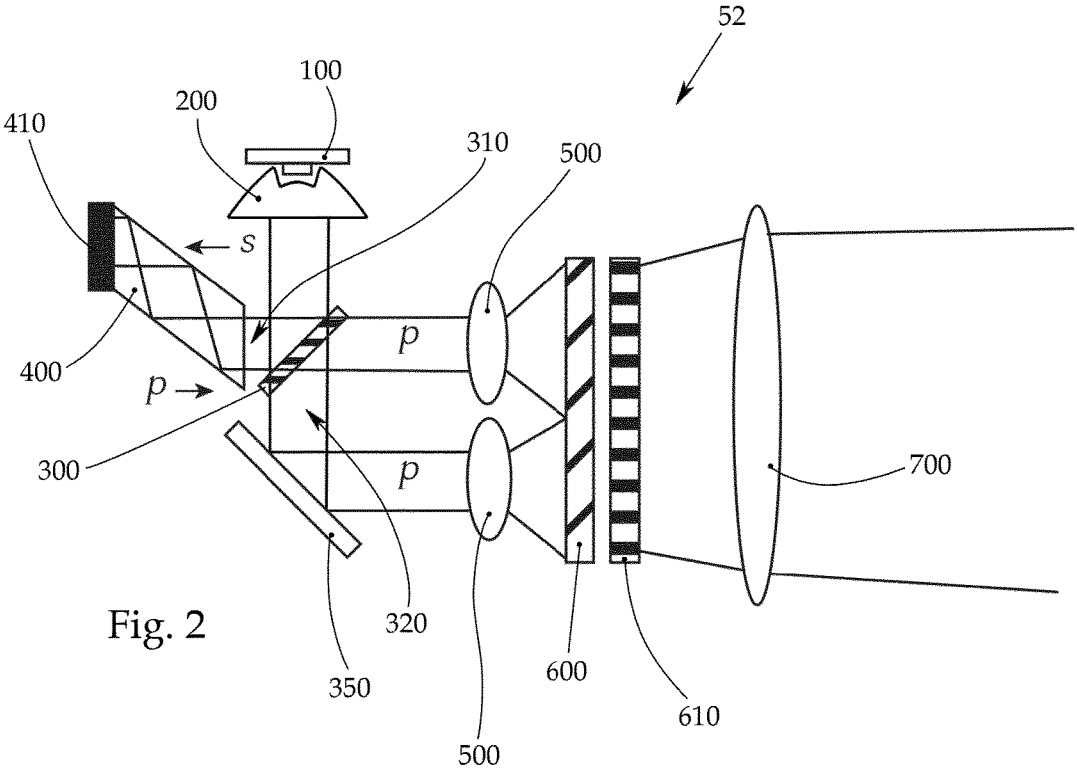
Figure 3:
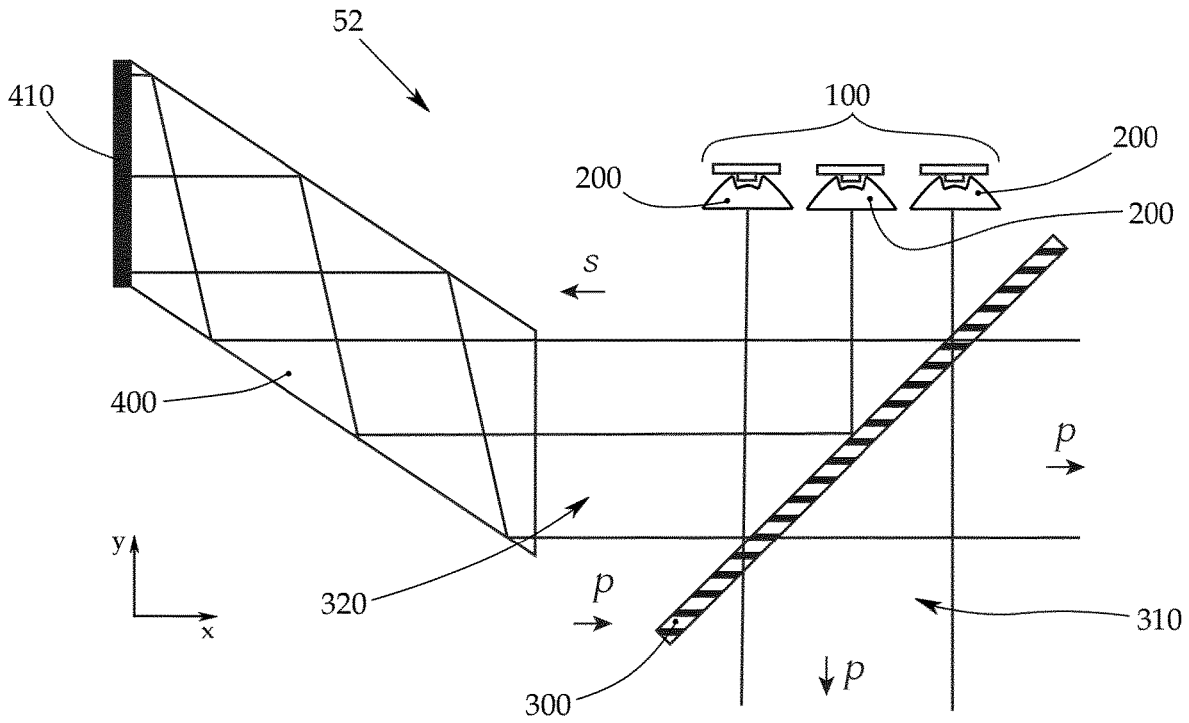
Figure 4:
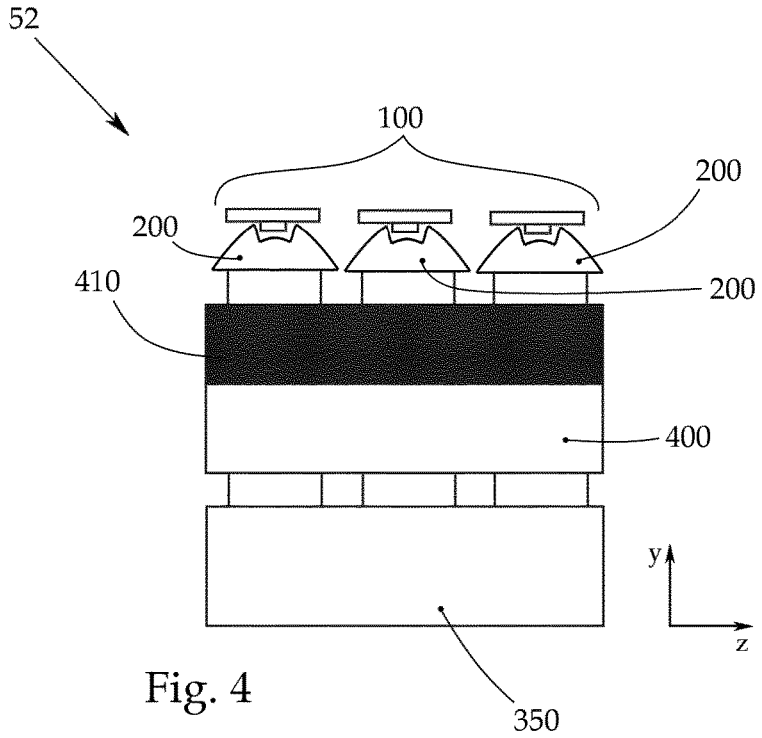
Figure 5:
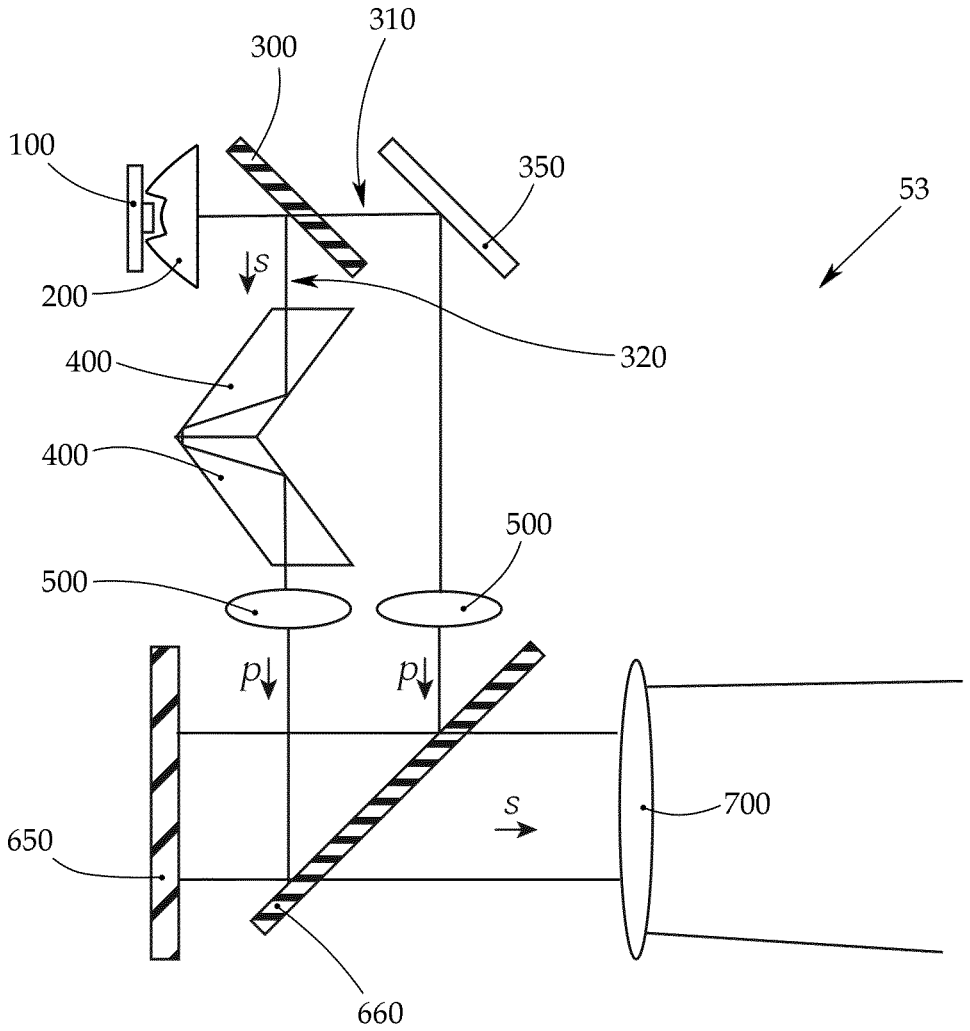

In what follows the invention is explained in more detail with the aid of exemplary figures. Here:

FIG. 1 shows an exemplary illumination device with two Fresnel parallelepipeds arranged directly behind one another, FIG. 2 shows another example with a Fresnel parallelepiped, wherein one end face of the parallelepiped has a mirror coating, FIG. 3 shows a detailed view of the structure of the example in FIG. 2, wherein a plurality of LEDs are provided as light sources, FIG. 4 shows a detailed view along the x-axis of the structure in FIG. 3, and FIG. 5 shows another example with two Fresnel parallelepipeds arranged directly behind one another, and an LCoS.

FIG. 1 shows an illumination device 51, comprising an illumination means 100, which in this example of embodiment is embodied as an LED, and is configured to emit light beams, wherein the light beams can be collimated by a lens system 200 installed downstream of the illumination means 100 in the main direction of radiation, that is to say, the light beams of the illumination means are directed so as to be parallel, or essentially parallel.

The term "main direction of radiation" is understood to mean the direction in which the illumination means emits with most intensity, or most light, by virtue of its directivity.

Furthermore, the illumination device in FIG. 1 comprises a polarising beam splitter 300, installed downstream of the lens system 200, which splits the light beams collimated by the lens system 200 into a first and a second linearly polarised beam path 310, 320, wherein the polarisation directions of the beam paths 310, 320 are rotated through 90° relative to one another.

It should be noted that the polarising beam splitter 300 in FIG. 1 is positioned at a 45° angle to the main direction of radiation of the light beams collimated by the lens system 200, but other positions of the beam splitter 300 are also possible.

In general, light polarised linearly at right angles to the plane of incidence is referred to as the transverse component TE, and is allotted the abbreviation "s". Light polarised linearly parallel to the plane of incidence is usually referred to as a transverse magnetic component TM and is allotted the abbreviation "p", wherein the abbreviations "s" and "p" can be found in the figures in the interests of a better overview.

The term "plane of incidence" is a well-known term from the field of optics, and generally refers to the plane defined by the direction of incidence of light incident on an interface and the perpendicular to that interface. The state of polarisation of the light is usually specified with respect to the plane of incidence.

Furthermore, a first means for polarisation rotation 400, which is positioned downstream of the polarising beam splitter 300 in the second beam path 320, and is arranged to rotate the polarisation direction of the second beam path 320 through 90° such that the second beam path 320 has the same polarisation direction as the first beam path 310.

The first means for polarisation rotation 400 in this example is designed as two Fresnel parallelepipeds, wherein the parallelepipeds are arranged directly behind one another, such that end faces of the respective parallelepipeds are arranged relative to one another without any distance between them.

A Fresnel parallelepiped, which is usually a translucent body formed, for example, from crown glass, polycarbonate or Tarflon, enables the conversion of linearly polarised light into circularly polarised light by means of double total reflection.

For this purpose, linearly polarised light is directed at right angles, that is to say, orthogonally, onto one end face of the parallelepiped, wherein the light does not experience any alteration in direction. The light then falls onto a first inclined longitudinal surface of the prism, wherein the angle of incidence of the light onto this longitudinal surface is greater than the critical angle of total reflection, and the light is totally reflected.

The thereby resulting phase shift causes the originally linearly polarised light to become elliptically polarised light. For the generation of circularly polarised light, a second total reflection within the prism is necessary.

The angle of incidence depends on the refractive index of the material used, for example crown glass, whose refractive index is 1.51.

In general, circularly polarised light can be obtained by the summation of two linearly polarised waves, at right angles to one another, of equal amplitude and matching phase shift. In the same way, any linearly polarised wave can be represented as the sum of a left-hand and a right-hand circularly polarised wave.

The phase difference produced by a Fresnel parallelepiped shows little or no dependence on the wavelength of the incident light over a wide range, which means that light sources that emit white light or polychromatic light can also be used, wherein "white light" means light of such a spectral composition that in persons it produces the impression of the colour "white".

In the case of two Fresnel parallelepipeds arranged directly one behind another, which have the same properties in terms of material and shape, a total of four total reflections occur, which, after leaving the two prisms, convert the incident linearly polarised light into linearly polarised light rotated through 90°, wherein the light maintains its direction.

Furthermore, a reflective means 350 is arranged in the first beam path 310, which reflective means 350 redirects the first beam path 310 essentially in the direction of the second beam path 320, which has been changed by the first means for polarisation rotation 400.

Furthermore, the illumination device 51 comprises a single second means for polarisation rotation 600, which is installed downstream of the first means for polarisation rotation 400 and the reflective means 350, wherein the second means for polarisation 600 in the example of embodiment in FIG. 1 is designed as a liquid crystal element, which comprises a plurality of segments, that is to say, liquid crystals, which can be transposed between an active and an inactive state by means of electrical signals, wherein the polarisation direction of the light beams can be rotated in the active state, preferably through 90°, and experiences no alteration in the inactive state.

Two optical elements 500, for example lenses or reflectors, are positioned in front of the second means for polarisation rotation, that is to say, the liquid crystal element 600, which optical elements are each assigned to a beam path 310, 320 and configured to enable an homogeneous illumination of the liquid crystal element 600 by the beam paths 310, 320 incident onto the liquid crystal element 600. In the examples shown, the optical elements 500 are designed as optical lenses.

A polarisation filter means 610 is installed downstream of the liquid crystal element 600, which polarisation filter means 610 is configured to transmit, or to absorb/block, the light beams rotated with respect to the polarisation direction by the segments, that is to say, the liquid crystals, of the liquid crystal element 600, as a result of which the desired light image or light distribution is generated.

A projection lens 700 is provided for purposes of generating a light distribution, or partial light distribution, of a light function ahead of a motor vehicle.

Provision can be made for such an illumination device 51, 52, 53 to be able to be used to generate the "main beam" light function, wherein the illumination device 51, 52, 53 generates for this "main beam" light function a light distribution which, when the illumination device 51, 52, 53 is installed in a motor vehicle, generates ahead of the motor vehicle a main beam distribution in accordance with the legal requirements.

Provision can be made for such a illumination device 51, 52, 53 to be able to be used to generate the "dipped beam" light function, wherein the illumination device generates for this "dipped beam" light function a light distribution which, when the illumination device 51, 52, 53 is installed in a motor vehicle, generates a dipped beam distribution ahead of the motor vehicle in accordance with the legal requirements.

The light functions, or light distributions, listed above are not exhaustive and relate to the example of embodiment in FIG. 1, together with other possible forms of embodiment, wherein the illumination devices 51, 52, 53 can also generate combinations of these light functions, and/or can only generate a partial light distribution, that is to say, for example, only part of a main beam, dipped beam, fog or daytime running light distribution.

FIG. 2 shows another example of an illumination device 52, wherein, in contrast to the form of embodiment in FIG. 1, the first means for polarisation rotation 400 is designed as a Fresnel parallelepiped, wherein one end face 410 of the parallelepiped 400 is mirrored.

Here, the light, which is linearly polarised at right angles by a polarising beam splitter 300, and is identified as "s" in FIG. 2, is coupled into the Fresnel parallelepiped 400 and, after two total reflections, strikes the mirrored front surface 410, wherein the light, that is to say, the light beams, are reflected into the opposite direction, and in turn experience two total reflections within the parallelepiped 400, and have a polarisation direction rotated through 90°, that is to say, a parallel linearly polarised light, which is identified as "p" in FIG. 2, before it is decoupled from, that is to say, exits from, the parallelepiped.

Here the direction of the decoupled light, that is to say, the direction of exit, is opposite to the direction of entry, that is to say, the direction of the encoupled light, as shown in FIG. 2.

The parallel linearly polarised light exiting from the Fresnel parallelepiped 400 is transmitted unaltered by the polarising beam splitter 300.

The remaining structure of the example shown in FIG. 2 essentially resembles the structure of the example in FIG. 1.

FIG. 3 shows a detailed view of the structure in FIG. 2, wherein the illumination means 100 is formed by a plurality of LEDs, each of which comprises a downstream lens system 200. A TIR lens can, for example, be provided as the lens system 200.

FIG. 4 shows a perspective view along the x-axis of the detailed view in FIG. 3, wherein it can be discerned that the illumination means 100 from the example in FIGS. 3 and 4 has both a series of light sources along the x-axis and also a series of light sources along the z-axis.

The illumination means 100 is, as it were, formed from a matrix of light sources, wherein provision can also be made for the illumination means 100 to be formed from just one series of light sources, that is to say, one light source array.

FIG. 5 shows an illumination device 53, comprising an illumination means 100, which in this example of embodiment is embodied as an LED, and is configured to emit light beams, wherein the light beams can be collimated by a lens system 200 installed downstream of the illumination means 100 in the main direction of radiation, that is to say, the light beams of the illumination means are directed so as to be parallel, or essentially parallel.

The illumination device in FIG. 5 further comprises a polarising beam splitter 300 installed downstream of the lens system 200, which splits the light beams collimated by the lens system 200 into a first and a second linearly polarised beam path 310, 320, wherein the polarisation directions of the beam paths 310, 320 are rotated through 90° relative to one another.

It should be noted that the polarising beam splitter 300 in FIG. 5 is positioned at a 45° angle to the main direction of radiation of the light beams collimated by the lens system 200, but other positions of the beam splitter 300 are also possible.

Furthermore, a first means for polarisation rotation 400, which is positioned downstream of the polarising beam splitter 300 in the second beam path 320, is configured to rotate the polarisation direction of the second beam path 320 through 90°, such that the second beam path 320 has the same polarisation direction as the first beam path 310.

In this example the first means for polarisation rotation 400 is designed as two Fresnel parallelepipeds, wherein the parallelepipeds are arranged directly behind one another, such that end faces of the respective parallelepipeds are arranged relative to one another without any distance between them.

Furthermore, a reflective means 350 is arranged in the first beam path 310, which reflective means 350 redirects the first beam path 310 essentially in the direction of the second beam path 320 that has been altered by the first means for polarisation rotation 400.

Furthermore, the illumination device 53 comprises a polarisation filter means 660, which is installed downstream of the Fresnel parallelepipeds 400 and the reflective means 350, wherein the polarisation filter means 660 redirects or reflects the light paths 310, 320 incident thereon, which have the same polarisation direction, onto a second means for polarisation rotation 650. In the example in FIG. 5, the polarisation filter means 660 is arranged to function as a polarising beam splitter in a similar manner to the polarising beam splitter 300 in the previous examples.

In FIG. 5 the second means for polarisation rotation 650 is designed as an LCoS element. In contrast to LC displays, that is to say, the liquid crystal element 600, in the previous examples of embodiment, an LCoS (liquid crystal on silicon) 650 does not allow light to pass through, but rather reflects it, wherein the LCoS 650, in a similar manner to the liquid crystal element 600, can be transferred into an active or an inactive state. More detailed explanations regarding the inactive or active state can be found in the statements with reference to FIG. 1.

Here the direction of the decoupled light, that is to say, the direction of exit, of the beam paths 310, 320 from the LCoS element 650, is opposite to the direction of entry, that is to say, the direction of the encoupled light, of the beam paths 310, 320, that is to say, of the light, as shown in FIG. 5.

The light emerging from the segments, that is to say, the liquid crystals, of the LCoS element 650, and altered in its polarisation direction is transmitted or blocked by the polarisation filter means 660, as a result of which the desired light image is generated, wherein a projection lens 700 is installed downstream of the polarisation filter means 660, which projection lens is provided for the generation of a light distribution or a partial light distribution of a light function ahead of a motor vehicle.

Furthermore, two optical elements 500 are positioned upstream of the polarisation filter medium 660, which are each assigned to a beam path 310, 320, and are configured to enable a homogeneous illumination of the polarisation filter medium 660 by the beam paths 310, 320 incident on the polarisation filter medium 660.

It should be noted that all the examples shown in the figures can be provided in, and as part of, a motor vehicle headlight.

LIST OF REFERENCE SYMBOLS

Illumination device 51, 52, 53
Illumination means 100
Lens system 200
Polarising beam splitter 300
First beam path 310
Second beam path 320
Reflective means 350
First means for polarisation rotation 400
Fresnel parallelepiped 400
Mirrored front surface 410
Optical element 500
Second means for polarisation rotation 600
Liquid crystal element 600
LCoS 650
Projection lens 700

The invention claimed is:

1. An illumination device (51, 52, 53) for a motor vehicle headlight, the illumination device comprising:

a lighting means (100), which is configured to emit light beams, wherein the light beams can be collimated by at least one lens system (200) installed downstream of the lighting means in the main direction of radiation, a polarising beam splitter (300) installed downstream of the at least one lens system (200), which splits the light beams collimated by the lens system (200) into a first and a second linearly polarised beam path (310, 320), wherein the polarisation directions of the beam paths (310,320) are rotated through 90° relative to one another, a first means for polarisation rotation (400), which is configured to rotate the polarisation direction of the second beam path (320) through 90°, such that the second beam path (320) has the polarisation direction of the first beam path (310), a reflective means (350), which is configured to redirect the first beam path (310) essentially into the direction of the second beam path (320) altered by the first means for polarisation rotation (400), a single second means for polarisation rotation (600) installed downstream of the first means for polarisation rotation (400) and the reflective means (350), which second means for polarisation rotation comprises at least one segment, which can be transposed between an active and an inactive state by means of electrical signals, wherein the polarisation of light beams can be rotated through 90° in the active state, and experiences no alteration in the inactive state, a polarisation filter means (610), which is installed downstream of the second means for polarisation rotation (600), which polarisation filter means (610) is configured to transmit or to block the light beams rotated in terms of polarisation by the second means for polarisation rotation (600) in the active or inactive state respectively, and at least one projection lens (700), which is provided for purposes of generating a light distribution, or a partial light distribution, of a light function ahead of a motor vehicle, wherein the first means for polarisation rotation (400) is designed as a Fresnel parallelepiped, wherein one end face of the parallelepiped is mirrored.

2. The illumination device according to claim 1, wherein the lighting means (100) comprises at least one light source.

3. The illumination device according to claim 1, wherein the lighting means (100) comprises two or more light sources.

4. The illumination device according to claim 1, wherein the at least one lens system (200) is designed as a TIR lens.

5. The illumination device according to claim 1, wherein the Fresnel parallelepiped is formed from crown glass, polycarbonate or Tarflon.

6. The illumination device according to claim 1, wherein the second means for polarisation rotation (600) is designed as a liquid crystal element.

7. The illumination device according to claim 1, wherein the reflective means (350) is designed as a mirror.

8. The illumination device according to claim 1, wherein the second means for polarisation rotation (600) is a liquid crystal on silicon (LCoS) element.

9. The illumination device according to claim 1, wherein at least one optical element (500) is installed upstream of the second means for polarisation rotation (600), which optical element is configured to enable homogeneous illumination of the second means for polarisation rotation (600) by the beam paths incident on the second means for polarisation rotation (600).

10. A motor vehicle headlight comprising at least one illumination device according to claim 1.

11. The illumination device according to claim 2, wherein the at least one light source is designed as an LED.

12. The illumination device according to claim 3, wherein each light source is assigned its own lens system (200).

13. The illumination device according to claim 9, wherein two optical elements (500) are installed upstream of the second means for polarisation rotation (600), wherein the optical elements are each assigned to one beam path (310, 320).

14. An illumination device (51, 52, 53) for a motor vehicle headlight, the illumination device comprising:

a lighting means (100), which is configured to emit light beams, wherein the light beams can be collimated by at least one lens system (200) installed downstream of the lighting means in the main direction of radiation, a polarising beam splitter (300) installed downstream of the at least one lens system (200), which splits the light beams collimated by the lens system (200) into a first and a second linearly polarised beam path (310, 320), wherein the polarisation directions of the beam paths (310,320) are rotated through 90° relative to one another, a first means for polarisation rotation (400), which is configured to rotate the polarisation direction of the second beam path (320) through 90°, such that the second beam path (320) has the polarisation direction of the first beam path (310), a reflective means (350), which is configured to redirect the first beam path (310) essentially into the direction of the second beam path (320) altered by the first means for polarisation rotation (400), a single second means for polarisation rotation (600) installed downstream of the first means for polarisation rotation (400) and the reflective means (350), which second means for polarisation rotation comprises at least one segment, which can be transposed between an active and an inactive state by means of electrical signals, wherein the polarisation of light beams can be rotated through 90° in the active state, and experiences no alteration in the inactive state, a polarisation filter means (610), which is installed downstream of the second means for polarisation rotation (600), which polarisation filter means (610) is configured to transmit or to block the light beams rotated in terms of polarisation by the second means for polarisation rotation (600) in the active or inactive state respectively, and at least one projection lens (700), which is provided for purposes of generating a light distribution, or a partial light distribution, of a light function ahead of a motor vehicle, wherein the first means for polarisation rotation (400) is designed as two Fresnel parallelepipeds, wherein the two parallelepipeds are arranged directly behind one another.

15. The illumination device according to claim 14, wherein the lighting means (100) comprises at least one light source, which comprises an LED.

16. The illumination device according to claim 14, wherein the lighting means (100) comprises two or more light sources.

17. The illumination device according to claim 14, wherein the at least one lens system (200) is designed as a TIR lens.

18. The illumination device according to claim 14, wherein the second means for polarisation rotation (600) comprises a liquid crystal element or a liquid crystal on silicon (LCoS) element.

19. The illumination device according to claim 14, wherein the reflective means (350) comprises a mirror.

20. The illumination device according to claim 16, wherein each light source is assigned its own lens system (200).

* * * * *